US006280225B1

(12) United States Patent
Nishide et al.

(10) Patent No.: US 6,280,225 B1
(45) Date of Patent: Aug. 28, 2001

(54) ELECTRICAL CONNECTOR

(75) Inventors: Satoru Nishide; Nori Inoue; Hajime Kawase, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/556,861

(22) Filed: Apr. 21, 2000

(30) Foreign Application Priority Data

Apr. 23, 1999 (JP) ..... 11-116550

(51) Int. Cl.[7] ..... H01R 13/62
(52) U.S. Cl. ..... 439/352; 439/159
(58) Field of Search ..... 439/159, 352, 439/923

(56) References Cited

U.S. PATENT DOCUMENTS 4,077,689 * 3/1978 Feldberg ..... 339/75
4,655,526 * 4/1987 Shaffer ..... 339/74
5,876,230 3/1999 Nishide et al. .
5,938,466 * 8/1999 Suzuki et al. ..... 439/352
6,109,956 * 8/2000 Kawase et al. ..... 439/489

FOREIGN PATENT DOCUMENTS 789 425 8/1997 (EP) .
WO 86/01645 3/1986 (WO) .

* cited by examiner

*Primary Examiner*—Gary Paumen
*Assistant Examiner*—Phuongchi Nguyen
(74) *Attorney, Agent, or Firm*—Banner & Witcoff, Ltd

(57) ABSTRACT

A connector provided with a half-fitting prevention function has a simplified configuration. A spring 40 is provided with a spring member 44 located to the posterior of a spring pressing member 41 which is pressed directly by a female housing. This spring member 44 is compressed when it receives a pressing force. The spring pressing member 41 and the spring member 44 are formed in a unified manner from plastic. The spring 40 is housed within a spring housing chamber 30 of a male housing 20. If the fitting of the two housings is halted part-way through the operation, the spring member 44 which has been compressed is released, the force which has been accumulated thus far is released, and the female housing is thereby caused to move in a direction of separation.

8 Claims, 4 Drawing Sheets

ELECTRICAL CONNECTOR

TECHNICAL FIELD

The present invention relates to an electrical connector provided with a half-fitting prevention function.

BACKGROUND TO THE INVENTION

One example of an electrical connector provided with a spring means for detecting the fitted state of a male or female housing is shown in JP-9-219257. This connector has a hood provided on a male connector, and is capable of fitting with a female connector. Two metal springs and a plastic spring pressing member are housed within a housing chamber provided adjacent to the hood. When the two housings are fitted together, the spring pressing member makes contact with the female housing and is pushed in an interior direction. The metal springs are resiliently compressed. If the fitting operation is halted part-way through, the compressed spring force is released, and the female housing moves back; the half-fitted state of the two housings is thus detected.

However, in the conventional example, the metal springs and the spring pressing member are formed separately. As a result, the number of components of the connector is large and the cost thereof increases. Moreover, the assembly operation is troublesome and operability worsens.

SUMMARY OF THE INVENTION

According to the invention there is provided a connector comprising two housings adapted for mutual fitting together, one of said housings having both a spring and a spring pressing member for contact with other of said housings, and said spring being adapted to resist mutual fitting until, in use, the housings are in a fully fitted state, characterised in that said spring and spring pressing member are formed in one piece from a plastics material.

Preferably, the spring is housed in a chamber of one of the housings and has both front and rear abutments between which the spring is retained under slight compression. The movable end of the spring preferably has an upstanding protrusion for engagement with the front abutment.

The spring is preferably a planar serpentine moulding and may consist of straight limbs merging at angles in the manner of a zig-zag. The angles may be arcuate. Alternatively, the spring may define spaces between converging and diverging limbs, these spaces being, for example, diamond or arcuate in shape. In the latter example the spaces may be oval.

In a preferred embodiment the other of said housings includes a resilient latching arm for latching said housings in a fully fitted state, the latching arm being adapted for bending into contact with said spring pressing member as said housings are fitted together, and the latching arm disengaging said spring pressing member as the housings reach the fully fitted state.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

Figure 1:
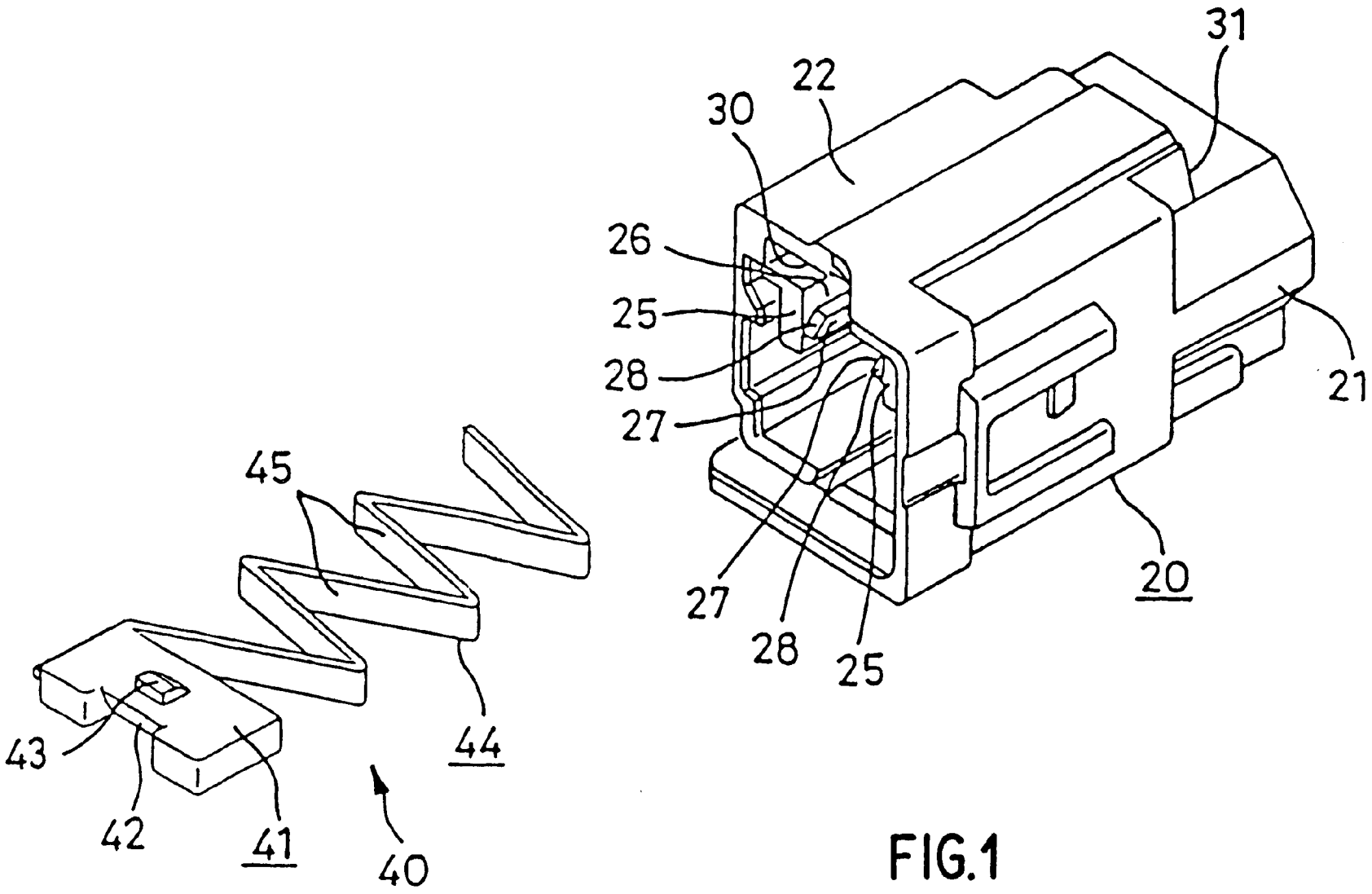
FIG. 1 is a diagonal view of a spring and a male housing of a first embodiment.

A first embodiment of the present invention is described below with the aid of FIGS. 1 to 4. A connector comprises a female connector housing 10 and a male connector housing 20. The female housing 10 is on the left in FIG. 2, and the male housing 20 is on the right. The two housings 10 and 20 are capable of fitting mutually together, a spring 40 for preventing half-fitting being housed within the male housing 20. The fitting face sides of the two housings 10 and 20 shall be considered to be the anterior side.

The female housing 10 is block-like, two cavities 11 being aligned therein in a width-wise direction. A female terminal fitting 12 is maintained in each cavity in a latched state by a prescribed stopping configuration. A locking arm 14 for maintaining the two housings 10 and 20 in a fitted state is provided on an upper face of the female housing 10. Furthermore, an operating member 13 protrudes from a posterior end portion of this upper face, this operating member 13 being used for pushing the female housing 10 when the two housings 10 and 20 are to be fitted together.

The locking arm 14 has a cantilevered shape, a base end thereof being formed at an anterior end of the female housing 10, a free end thereof extending in a posterior direction. This locking arm 14 is capable of bending in an up-down direction. Locking protrusions 15 protrude from both side faces of the locking arm 14, these locking protrusions 15 engaging against stopping members 27 of the male housing 20. Fitting face ends of these locking protrusions 15 have a long and narrow shape, lower faces thereof forming tapered faces 16 and opposing faces thereof forming stopping faces 17 which are engaged against the stopping members 27. The tapered faces 16 rise over the stopping members 27, thereby raising the free end of the locking arm 14 (see FIG. 3). A pressing protrusion 18 is provided on an upper face of the locking arm 14 at a location to the posterior of the locking protrusions 15. When the locking arm 14 is bent to a raised state, the pressing protrusion 18 makes contact with and presses against the spring 40 of the male housing 20. Furthermore, a releasing member 19 is provided on the free end of the locking arm 14 to allow a pushing operation in a downwards direction to be performed.

Figure 2:
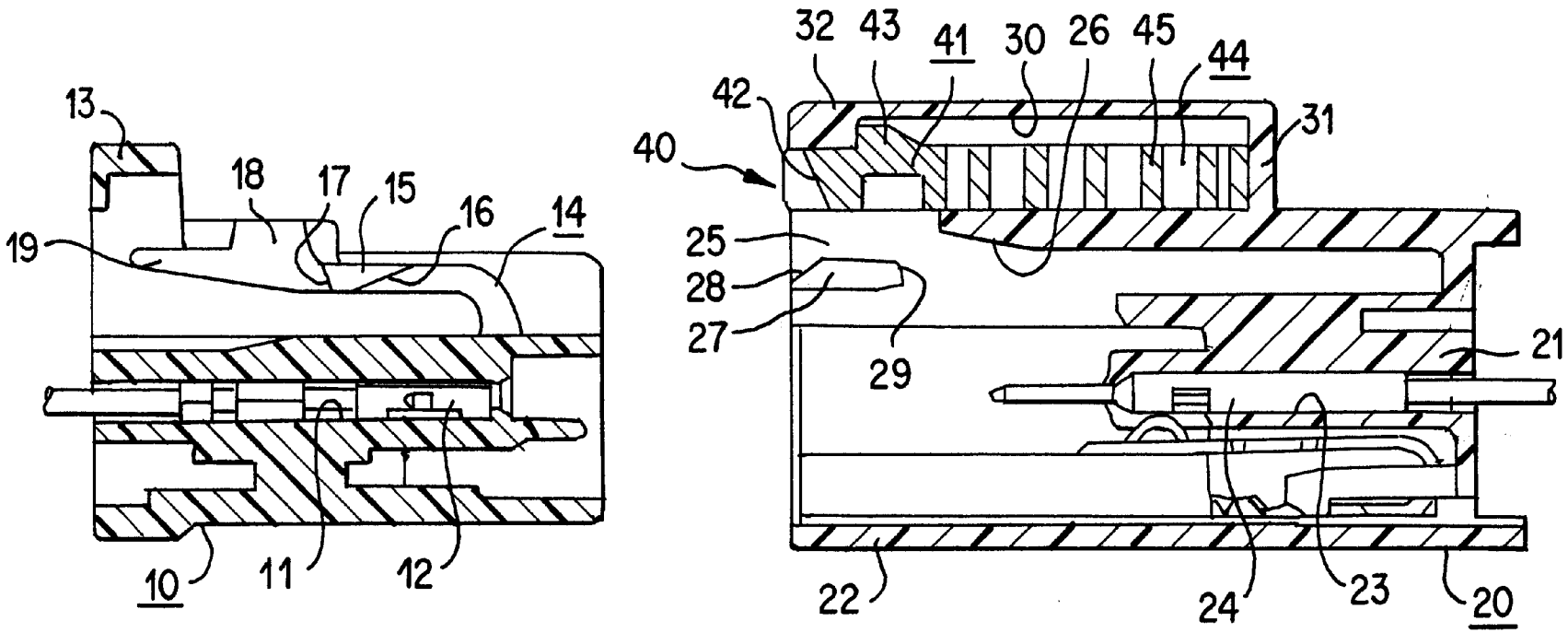
FIG. 2 is a cross-sectional view of a connector prior to being fitted together.

As shown in FIG. 1, the male housing 20 consists of a block-like terminal housing member 21, the anterior thereof being provided with a hood 22. The female housing 10 Fits within this hood 22. As shown in FIG. 2, two cavities 23 are aligned within the terminal housing member 21, these cavities 23 corresponding to the female housing 10. A male terminal fitting 24 is housed within each cavity 23, these male terminal fittings 24 being maintained in a latched state therein by a prescribed stopping configuration.

A pair of side walls 25 protrude in an anterior direction at an upper portion of the terminal housing member 21. A locking arm housing chamber 26 for housing the locking arm 14 of the female housing 10 is formed between these two side walls 25. Further, anterior edges of these side walls 25 are located in the same position as an anterior end of the hood 22 and join therewith. The stopping members 27 protrude inwards from an anterior end portion of the two side walls 25, these stopping members 27 engaging against the locking protrusions 15 of the locking arm 14. Tapering guiding faces 28 are formed on anterior upper faces of the stopping members 27, these guiding the tapered faces 16 as they rise over the stopping members 27. Stopping protrusions 29 of the stopping members 27 engage against the stopping faces 17 of the locking protrusions 15.

A spring housing chamber 30 for housing the spring 40 is formed in an upper portion of the locking arm housing chamber 26. A posterior wall 31 of the spring housing chamber 30 has the function of stopping the spring 40 in a posterior direction when this spring 40 is housed therein, and a hook member 32 provided at an anterior end of the spring housing chamber 30 stops the spring 40 in an anterior direction. A central portion of a lower face of this anterior end of the spring housing chamber 30 is open and joins with the locking arm housing chamber 26, the locking arm 14 entering therein when it has risen upwards.

The spring 40 is composed of a spring pressing member 41 which is pressed by the pressing protrusion 18 of the locking arm 14, and a spring member 44 which is located to the posterior of the spring pressing member 41 and is capable of resiliently changing shape. As shown in FIG. 1, the spring pressing member 41 and the spring member 44 are formed in one piece from plastic.

Figure 3:
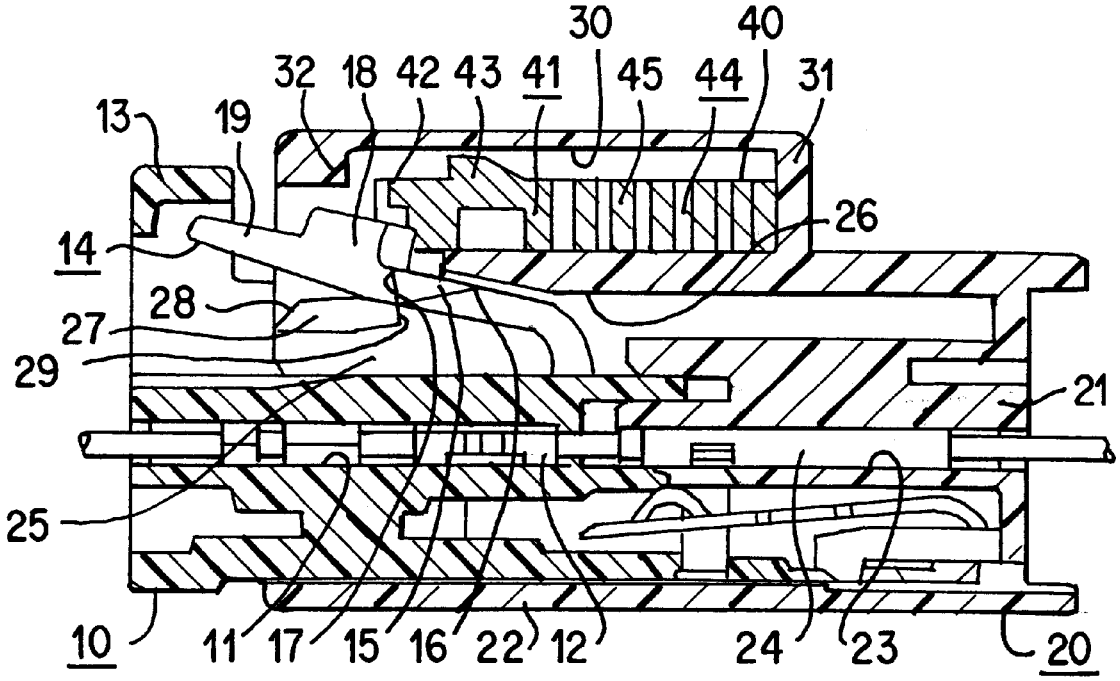
FIG. 3 is a cross-sectional view of a connector while being fitted together.

As shown in FIG. 3, a central portion at an anterior edge of the spring pressing member 41 is slightly concave. This forms a contact member 42 capable of making contact with the pressing protrusion 18 of the locking arm 14. When the contact member 42 is pressed by the pressing protrusion 18 of the locking arm 14, the spring pressing member 41 slides in a posterior direction into the spring housing chamber 30. Moreover, a hooked protrusion 43 is formed on an upper face of the spring pressing member 41. This hooked protrusion 43 engages against the hook member 32 of the spring housing chamber 30 and prevents the movement of the spring 40 in an anterior direction.

As shown in FIG. 1, the spring member 44 comprises strip-like plate members 45 which have a zigzag shape, an anterior end thereof being joined to one edge of a posterior end face of the spring pressing member 41. As shown in FIG. 2, a posterior end of the spring member 44 is supported by the posterior wall 31 of the spring housing chamber 30. When the spring pressing member 41 is pushed in a posterior direction the spring member 44 changes shape and is compressed in the direction of pushing. Furthermore, the force which the spring member 44 has accumulated during compression is released when the pushing force on the spring pressing member 41 is removed.

The present embodiment is configured as described above. Next, the operation thereof will be explained. The operating member 13 of the female housing 10 is pushed and the two housings 10 and 20 are fitted together from the separated state shown in FIG. 2.

The female housing 10 is inserted into the hood 22 and then the locking arm 14 enters the locking arm housing chamber 26. The tapered faces 16 of the locking protrusions 15 make contact with the guiding faces 28 of the stopping members 27 and, as fitting proceeds, the locking protrusions 15 rise over the guiding faces 28. In this manner, the locking arm 14 is bent upwards and assumes a state wherein the rear end thereof is raised (FIG. 3).

This bending of the locking arm 14 causes the pressing protrusion 18 to enter the spring housing chamber 30 of the male housing 20. Thereupon, the pressing protrusion 18 makes contact with the contact member 42 and presses it towards the interior. As shown in FIG. 3, the increased pressing force exerted on the female housing 10 slides the spring pressing member 41 towards the interior and causes the spring member 44 to be compressed. As the degree of compression of the spring member 44 increases, the force opposing fitting increases.

If the fitting operation of the two housings 10 and 20 is halted in this half-fitted state, the spring member 44, which is in a compressed state, is released, and the force accumulated thus far by the spring member 44 is released and causes the female housing 10 to move in a direction of separation. By this means, the half-fitted state of the two housings 10 and 20 can be determined.

Figure 4:
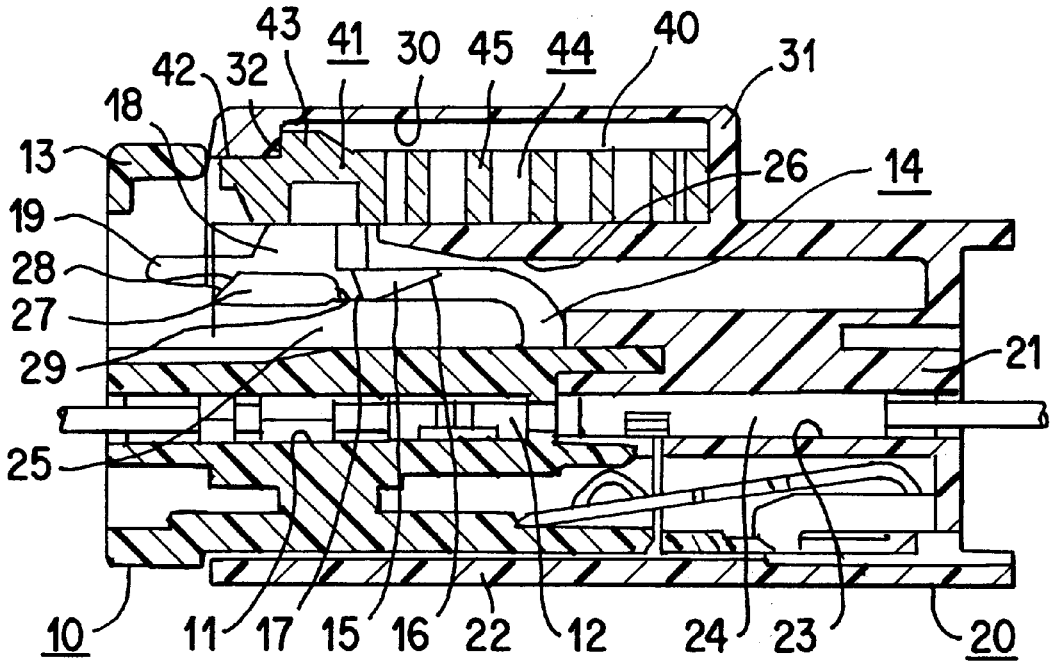
FIG. 4 is a cross-sectional view of a connector after being fitted together.

As fitting progresses, the locking protrusions 15 rise over the stopping members 27 and then, as shown in FIG. 4, the locking arm 14 moves resiliently downwards and returns to its original position. As the locking arm 14 changes position, the pressing protrusion 18 of the locking protrusions 15 is moved downwards and its contact with the contact member 42 of the spring pressing member 41 is released. As a result, the spring member 44 returns resiliently from its compressed state to its original position, the spring pressing member 41 is caused to slide in an anterior direction, and the hooked protrusion 43 engages against the hook member 32 and returns to the state shown in FIG. 2. In this manner, after the two housings 10 and 20 have been fitted together, the spring member 44 returns to its state prior to being compressed, thereby preventing fatigue from occurring in this plastic spring member 44.

As the locking arm 14 returns resiliently to its original position, the stopping faces 17 of the locking protrusions 15 are engaged by the stopping protrusions 29 of the stopping members 27. In this manner the two housings 10 and 20 reach a correctly fitted state whereby the female and male terminal fittings 12 and 24 make contact. The two housings 10 and 20 are maintained in this state.

Furthermore, when the two housings 10 and 20 need to be separated for maintenance or the like, the releasing member 19 of the locking arm 14 is pushed downwards and the locking arm 14 is bent downwards. This operation releases the stopping faces 17 from their latched state against the stopping members 27, and the locking protrusions 15 move below the stopping member 27. From this state, the female housing 10 is pulled in a posterior direction, thereby separating the two housings 10 and 20.

According to the embodiment explained above, the spring 40 is formed in a unified manner from plastic. Consequently, the spring 40 can be manufactured easily. In addition, the number of components of the connector is decreased, thereby simplifying the assembly operation of the connector and simplifying the production of the connector. Moreover, the cost thereof decreases.

A second embodiment of the present invention is described below with the aid of FIG. 5. In this embodiment, the shape of the spring is different, and the resilient force thereof is increased.

Figure 5:
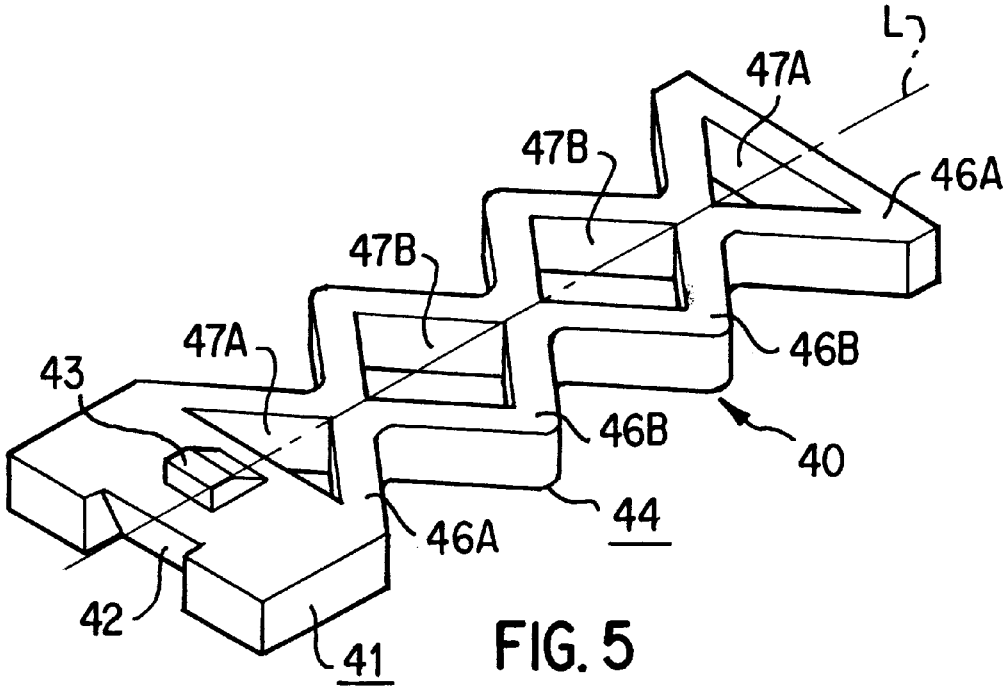
FIG. 5 is a diagonal view of a spring of a second embodiment.

As shown in FIG. 5, a spring 40 comprises a spring member 40 comprises a spring member 44 composed of a plurality of connecting spring component members 46A and 46B which join with both side edges of a posterior end face of a spring pressing member 41. Outer shapes of the spring component members 46A are triangular, and central spaces 47A formed in interior portions thereof have the same shape. Outer shapes of the spring component members 46B are diamond-shaped, and have diamond-shaped central spaces 47B formed in interior portions thereof. The spring member 44 comprises one spring component member 46A joined to the spring pressing member 41, the posterior thereof having two spring component members 46B joined thereto, the posterior of these two spring component members 46B having another sprint, component member 46A joined thereto, this last spring component member 46A facing the opposite direction relative to the first. This spring member 44 is formed in a symmetrical shape along a symmetrical axis L extending along a central line of the spring pressing member 41. That is, the symmetrical axis L is formed along a central line parallel to the direction of pressing of the spring pressing member 41.

The spring member 44 has a symmetrical shape. Consequently, when a pushing force is exerted on the spring pressing member 41, the spring member 44 receives this force equally on its right and left side and the spring member 44 is pushed in a straight manner. Furthermore, the spring member 44 comprises the spring component members 46A and 46B which unified. As a result, it is more difficult for the spring member 44 to resiliently change shape, and the releasing force thereof is increased to the extent that this difficulty is increased. Consequently, if the two housings 10 and 20 are stopped in a half-fitted state, the female housing 10 is caused to move back further, and the half-fitted state of the two housings 10 and 20 can be clearly determined.

The remaining structure, operation and effects are the same as the first embodiment and accordingly an explanation thereof is omitted.

Figure 6:
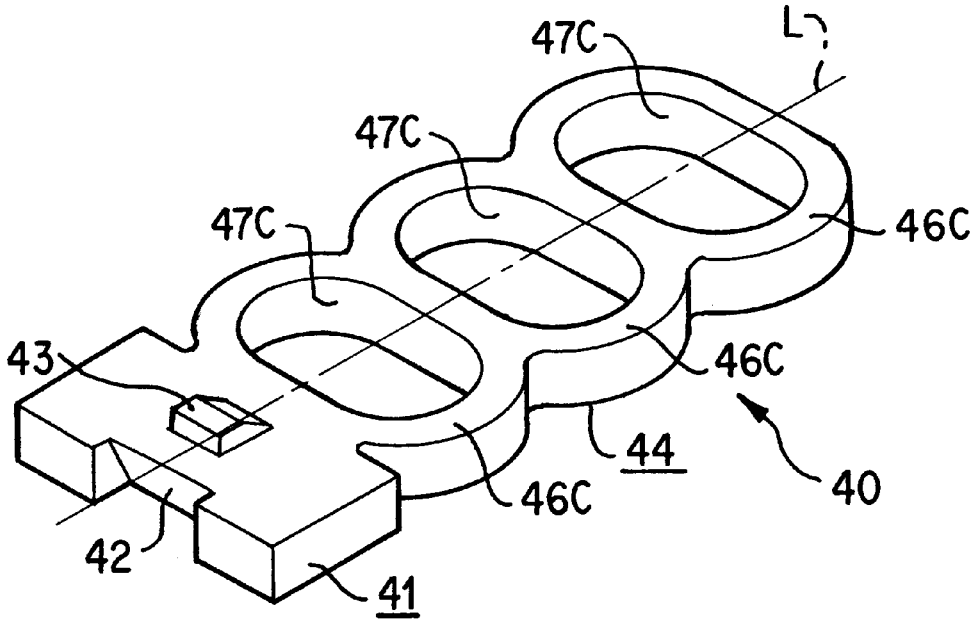
FIG. 6 is a diagonal view of a spring of a third embodiment.

A third embodiment of the present invention is described below with the aid of FIG. 6. In this embodiment, the shape of the spring component member is different. That is, as shown in FIG. 6, the outer shape of spring component members 46C which comprise a spring member 44 is an approximately oval shape, and central spaces 47C are formed in interior portions thereof and have the same shape. The spring member 44 is composed of three spring component members 46C which are joined together, the straight portions of these spring component members 46C being joined mutually together.

The remaining structure, operation and effects are the same as the second embodiment and accordingly an explanation thereof is omitted.

The present invention is not limited to the embodiments described above with the aid of figures. For example, the possibilities described below also lie within the technical range of the present invention. In addition, the present invention may be embodied in various other ways without deviating from the scope thereof.

(1) In contrast to the embodiment described above, the spring may be provided on the female housing, and the locking arm may be provided on the male housing.

(2) In the embodiment described above, the spring, which has been compressed while the two housings are half-fitted, is released when these housings are correctly fitted. However, according to the present invention, the spring may equally well remain compressed when the two housings have been correctly fitted.

(3) Furthermore, the pressing means of the spring need not be a locking arm.

What is claimed is:

1. A connector comprising two housings adapted for mutual fitting together, one of said housings having both a spring and a spring pressing member for contact with other of said housings, and said spring being adapted to resist mutual fitting until, in use, the housings are in a fully fitted state, wherein said spring and spring pressing member are formed in one piece from a plastic material, wherein said spring and spring pressing member are housed in a chamber of said one of said housings, the chamber having a rear abutment to resist compression of said spring, and a front abutment to resist expansion of said spring, and wherein said spring pressing member has a protrusion extending transversely to the direction of compression of said spring, said protrusion engaging said front abutment.

2. A connector according to claim 1 wherein said spring and spring pressing member are substantially symmetrical about the axis of compression of said spring.

3. A connector according to claim 1 wherein said spring comprises a planar serpentine moulding.

4. A connector according to claim 3 wherein the said serpentine moulding comprises straight limbs merging at angles in the manner of a zig-zag.

5. A connector according to claim 1 wherein said spring comprises a planar moulding having limb portions which join and separate in a sequential manner to define enclosed spaces.

6. A connector according to claim 5 wherein said limb portions define spaces in the shape of diamonds.

7. A connector according to claim 5 wherein said limb portions define spaces which are rounded.

8. A connector comprising two housings adapted for mutual fitting together, one of said housings having both a spring and a spring pressing member for contact with other of said housings, and said spring being adapted to resist mutual fitting until, in use, the housings are in a fully fitted state, wherein said spring and spring pressing member are formed in one piece from a plastic material, and wherein said other of said housings includes a resilient latching arm for latching said housings in a fully fitted state, the latching arm being adapted for bending into contact with said spring pressing member as said housings are fitted together, and the latching arm disengaging said spring pressing member as the housings reach the fully fitted state.

* * * * *